United States Patent [19]

Schrooder

[11] Patent Number: 4,708,224

[45] Date of Patent: Nov. 24, 1987

[54] APPARATUS FOR THE LOAD DEPENDENT CONTROL OF AN ELEVATOR

[75] Inventor: Joris Schrooder, Lucerne, Switzerland

[73] Assignee: Inventio AG, Hergiswil, Switzerland

[21] Appl. No.: 849,958

[22] Filed: Apr. 9, 1986

[30] Foreign Application Priority Data

Apr. 22, 1985 [CH] Switzerland ..... 01713/85

[51] Int. Cl.[4] ..... B66B 1/16

[52] U.S. Cl. ..... 187/122; 187/127

[58] Field of Search ..... 187/29, 122, 127; 340/19, 20

[56] References Cited

U.S. PATENT DOCUMENTS

| | | | |
|---|---|---|---|
| 3,543,883 | 12/1970 | Kuzara | 187/29 R |
| 3,967,702 | 7/1976 | Iwaska et al. | 187/29 R |
| 3,973,649 | 8/1976 | Iwasaka et al. | 187/29 R |
| 4,030,572 | 6/1977 | Kaneko et al. | 187/29 R |
| 4,044,860 | 10/1977 | Kaneko et al. | 187/29 R |
| 4,112,419 | 9/1978 | Kinoshita et al. | 340/19 R |
| 4,411,337 | 10/1983 | Schröder et al. | 187/29 R |

*Primary Examiner*—William M. Shoop, Jr.
*Assistant Examiner*—W. E. Duncanson, Jr.
*Attorney, Agent, or Firm*—Marshall & Melhorn

[57] ABSTRACT

An elevator control system includes a car load measuring device for generating a car load signal representing the number of passengers in an elevator car and a floor load sensor for generating a signal representing the number of passengers waiting for an elevator at each floor. As the elevator car approaches the next floor at which it could stop, the floor load sensor generates its signal for that floor which is combined with the car load signal in an adder to generate a signal representing the total car load if the elevator car were to stop. The signal representing the total load is compared with a signal representing a maximum permissible car load and, if the maximum has not been exceeded, an enable signal is generated to one input of each of a plurality of logic circuits. The second input of each logic circuit is connected to a memory cell for a corresponding floor in a floor call memory and the third input of each logic circuit is connected to the corresponding floor in the floor selector device. Thus, when the signal representing the next floor at which the elevator car could stop corresponds to a stored floor call for that floor and the total potential load does not exceed the maximum permissible load, the corresponding logic circuit will generate a stop signal to cause the elevator to stop at the respective floor.

20 Claims, 2 Drawing Figures

APPARATUS FOR THE LOAD DEPENDENT CONTROL OF AN ELEVATOR

BACKGROUND OF THE INVENTION

The invention relates, in general, to an apparatus for controlling an elevator based upon load, and, in particular, to an apparatus for determining whether to stop an elevator for a floor call based upon the current load in the elevator and the anticipated load to be added by stopping for the floor call.

Prior art automatic elevator controls typically include a selector for generating a signal representing the next floor along the path of travel of the elevator at which the elevator could stop. These controls also include a circuit for comparing the selector signal with floor calls stored in a memory. When a floor call and the selector signal match, the control signals the elevator to stop.

All elevators have weight limits imposed upon them to prevent them from becoming from overloaded. For example, some form of load sensing device is located in the elevator car to generate a signal corresponding to the load being carried by the elevator car. Typical devices measure either the actual weight or the number of passengers in the elevator car. Also, certain predetermined load limits can be imposed which may vary according to the traffic conditions. For example, the load limit may be adjusted to a low value during light traffic conditions and to a higher value during heavy traffic conditions, whereby the waiting times of the passengers at the floors can be reduced by having an elevator that has reached its load limit bypass the floor.

U.S. Pat. No. 3,504,770 discloses an elevator control for downward peak traffic. High load limit values are set corresponding to the traffic density expected Furthermore, each elevator is assigned to a certain number of floors, for example three, where at the lower one of the floors, all waiting passengers can be picked up and the elevator car will be approximately fully loaded. If the load value limit is reached at the floor above the lower floor, the elevator car will be caused to pass the lower floor. If the elevator stops but can not pick up all of the waiting passengers due to reaching the load limit value, a second elevator car must be utilized to serve the same floor, which causes increased time losses with respect to the entire elevator system.

U.S. Pat. Nos. 3,967,702; 3,973,649 and 4,030,572 all relate to a group elevator control which detects the number of passengers in the cars and the number of passengers waiting at the floors, and, based upon the hall calls and car calls registered, calculates the number of passengers traveling to various floors utilizing predetermined ratios. Hall call assignment is inhibited only after a load limit has been exceeded. Thus, an already overloaded car will continue to stop at hall calls which previously had been assigned to it.

SUMMARY OF THE INVENTION

Thus, there is a need for an elevator control which is responsive to the load in the car and the load waiting at a floor for determining that the car should stop if the combined load will not exceed the load limit of the car and for determining that the car should bypass the floor if the combined load would exceed the load limit of the car. The present invention concerns an apparatus for the load dependent control of an elevator which includes a floor selector device for generating a next floor signal representing the next floor at which the elevator car could stop, and a floor call memory for generating a floor call signal representing the floor calls to be serviced by the elevator. Also included is a circuit for generating an enable signal to permit the control to generate a stop signal to the car when the next floor signal and a stored floor call signal correspond and the load in the car plus the load at the selected floor call do not exceed a load limit for the car. A load sensor located in the car generates a car load signal representing the number of passengers in the elevator. A floor load sensor at each floor generates a floor load signal representing the number of passengers waiting at the floor. As the selector device generates the next floor signal, the corresponding floor load signal is added to the car load signal and the sum is compared with a signal representing the maximum load to be permitted. If the combined car load and floor load signals are less than or equal to the maximum limit, the control generates the enable signal to allow the stop signal to be generated.

The advantage of such an apparatus is that, especially at a high traffic density time in a downward direction, the time losses of earlier control systems are avoided since an elevator car will never stop at a floor where it can not pick up the full waiting passenger load. Thus, only one elevator will be required to stop at each floor where a floor call has been registered resulting in a more efficient utilization of the cars in a multi-car elevator system.

BRIEF DESCRIPTION OF THE DRAWINGS

The above as well as other objects of the invention will become apparent to one skilled in the art from reading the following detailed description of a preferred embodiment of the invention when considered in the light of the attached drawings in which.

DESCRIPTION OF THE PREFERRED EMBODIMENTS

Figure 1:
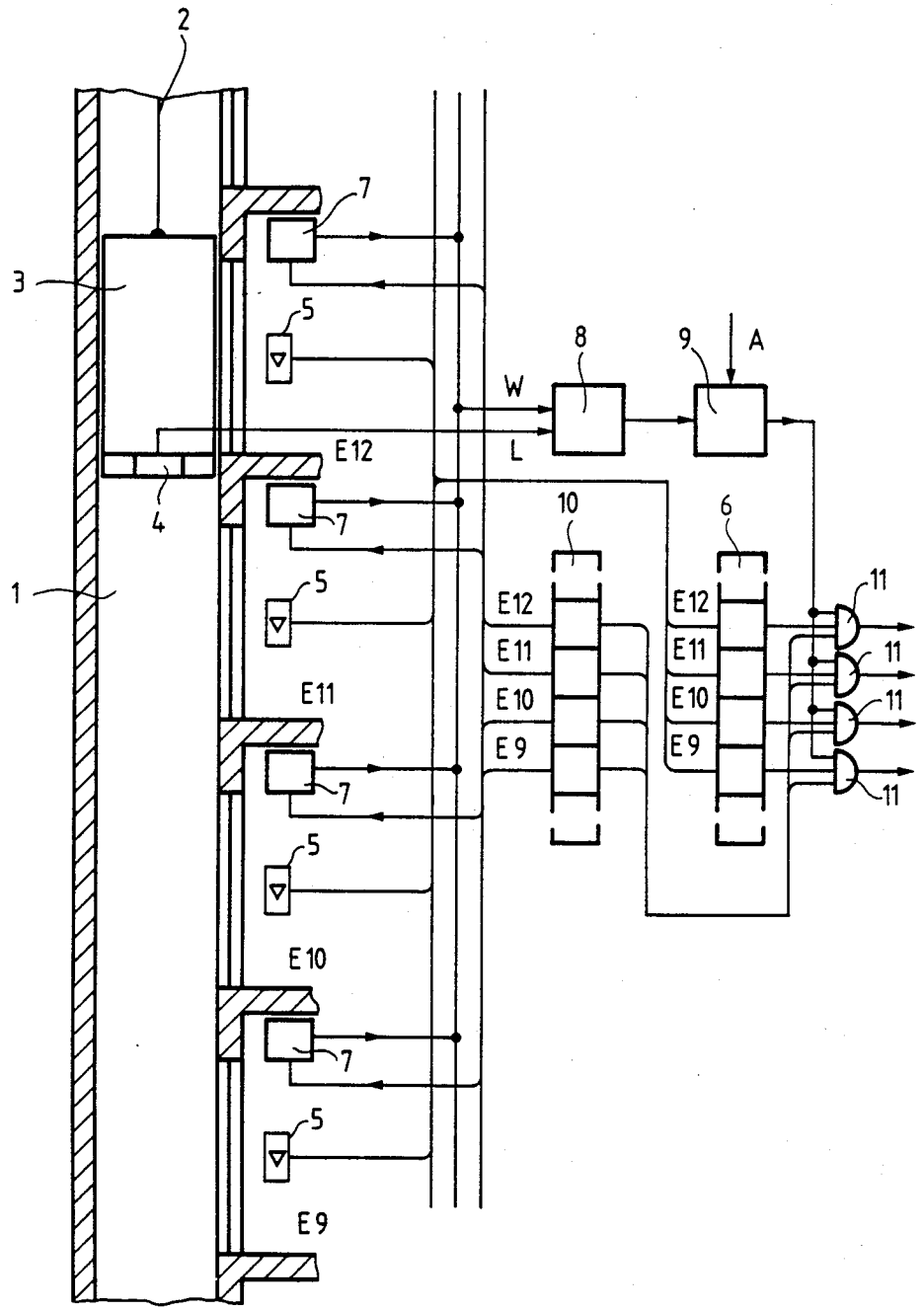
FIG. 1 is a schematic diagram of a portion of an elevator control system in accordance with the present invention.

FIG. 1 is a schematic representation of a portion of an elevator shaft and elevator along with a portion of an elevator control system in accordance with the present invention. The present invention is utilized to control a bank of elevators consisting of at least two elevator cars which serve at least one common floor. FIG. 1 is representative of each of the elevator cars and associated controls in the system.

An elevator shaft 1 serves a plurality of floors at a landing for each of the floors such as landings E9 through E12 representing four adjacent floors. The elevator shaft 1 guides an elevator car 3 which is suspended from a hoisting cable 2 connected to suitable equipment (not shown) for moving the elevator up and down the elevator shaft. The elevator 3 includes a car load measuring device 4 for determining the number L of passengers in the elevator car. The device 4 can be any one of the known devices for determining the number of passengers such as a weight sensing device with means for determining the number of passengers based upon an average weight, or a counting device which is triggered by each passenger entering or leaving the car.

Such devices are commercially utilized and are well know in the prior art.

At each of the floors E9 through E12, there is located floor call button 5 for registering downward calls. Each of the floor call buttons 5 is connected to a corresponding storage cell in a floor call register or memory 6. Once a waiting passenger has pushed the floor call button 5 at his floor, a floor call signal is generated and stored in the corresponding memory cell of the floor call memory 6. The stored signal is not cancelled until a car stops at the floor to pick up the waiting passenger. Also located at each of the floors E9-E12 is a floor load sensor 7 for generating a signal W representing the number of passengers waiting at the associated floor. The floor load sensor 7 can be any one of a number of commercially utilized devices.

The output of the car load measuring device 4 is connected to an input of an adder 8. The output of each of the floor load sensors 7 is connected to a second input of the adder 8. An output of the adder is connected to a first input of a comparator 9. A second input of the comparator 9 is connected to a source of a signal A representing a load limit value corresponding to the maximum permissible number of passengers for the elevator car 3. A floor selector 10 generates a signal representing the next floor at which the elevator car 3 could stop. The floor selector 10 includes a separate pair of outputs for each floor. A first one of the outputs for each floor is connected to an input of the corresponding floor load sensor 7. A plurality of logic circuits shown as AND gates, one for each floor, are provided for generating a stop signal to a control (not shown) for the elevator car 3. Each of the AND gates 11 has a first input connected to an output of the comparator 9. A second input of each of the AND gates 11 is connected to an associated one of the memory cells in the floor call memory 6. A third input of each of the AND gates 11 is connected to a second output from the associated floor of the floor selector 10.

As the elevator car 3 moves downwardly in the elevator shaft 1, the floor selector 10 generates a next floor signal representing the closest floor at which the elevator car could stop. Thus, floor selector 10 first generates a signal for floor E12 and then floors E11, E10 and E9 in succession as the elevator car descends. The next floor signal from the floor selector 10 is an input to the associated floor load sensor 7 to enable the sensor to generate the signal W corresponding to the number of passengers waiting at the associated floor. This signal is an input to the adder 8 along with the car load signal L from the car load measuring device 4. The signals L and W are added together to generate an output signal which represents the total number of passengers that would be in the elevator car 3 if the elevator were to stop at the next floor at which it could stop.

The comparator output signal is compared to the value of the signal A representing the maximum number of passengers allowed in the elevator car 3. If the output signal from the adder 8 is equal to or less than the value of the signal A, the comparator 9 will generate an enable signal to each of the logic circuits 11. The floor call memory 6 generates a floor call signal corresponding to a stored floor call to an associated one of the logic circuits 11. The floor selector 10 generates a next floor signal for the one of the floors at which the elevator car can stop. Thus, only the AND gate 11 having signals at all three of its inputs will generate a stop signal to a control circuit (not shown) which will direct the elevator car to stop at the corresponding one of the floors and pick up the waiting passengers. The elevator car will not stop at the next floor at which it could stop if there is no floor call in the memory 6 or the anticipated load exceeds the maximum load limit A since the AND gate 11 will generate a bypass signal.

Figure 2:
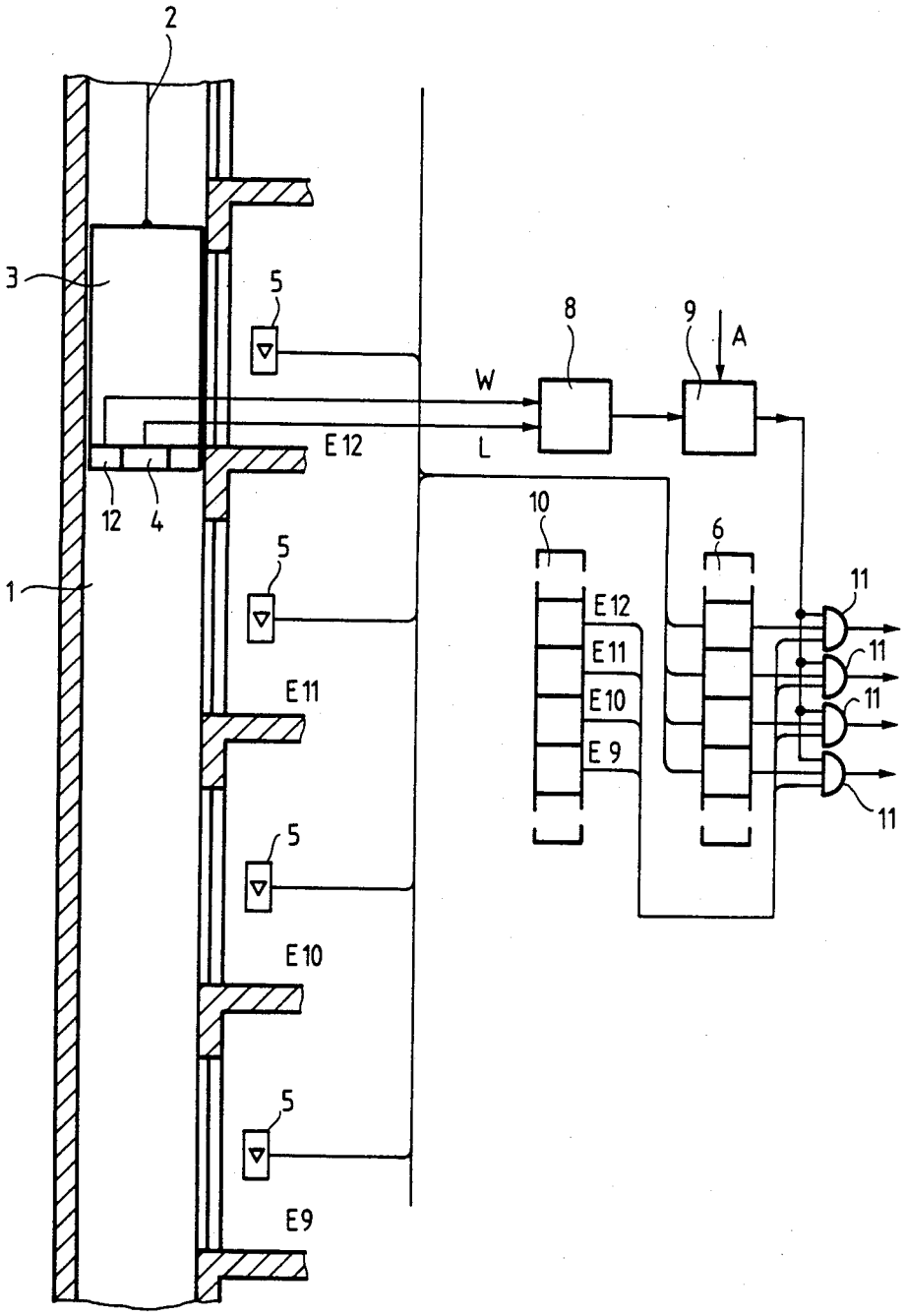
FIG. 2 is a schematic diagram of a portion of an elevator control system in accordance with a second embodiment of the present invention.

In FIG. 2, there is a schematic diagram of an alternate embodiment of the control apparatus according to the present invention. Like elements are designated with the same reference numerals in FIG. 1 and FIG. 2. In the circuit shown in FIG. 2, the floor load sensor 7 of FIG. 1 has been replaced by a load memory 12 positioned in the elevator car 3 for generating the signal W. The load memory is disclosed in European Patent No. 0 032 213. As the elevator car 3 travels through the building, the load memory 12 registered the change in the number of passengers at each floor and calculates a mean value representing the probable number of passengers waiting at the next floor to be served by the elevator car. As the elevator car 3 approaches the next floor at which it could stop, the load memory 12 generates a corresponding signal W representing the probable number of passengers waiting at that floor. The adder 8 then sums the signals W and L and generates the result to the comparator 9 which determines whether to generate an enable signal to the logic circuits 11.

In accordance with the provisions of the patent statutes, the principle and mode of operation of the present invention have been explained and illustrated in its preferred embodiments. However, it must be appreciated that the present invention can be practiced otherwise than as specifically explained and illustrated without departing from its spirit or scope.

What is claimed is:

1. In an apparatus for controlling an elevator car including a selector device for generating a next floor signal representing the next floor at which the car could stop, a car load measuring device for generating a car load signal representing the number (L) of passengers in the car, a floor memoroy for generating a floor call signal representing floor calls to be serviced by the car, and control means for generating a stop signal to stop the elevator car, the control means comprising:

floor load sensor means for generating a floor load signal representing the number (W) of passengers waiting at the next floor at which an associated elevator car could stop; and means responsive to said floor load signal, a floor call signal for the next floor, a car load signal representing the number (L) of passengers in the associated elevator car, and a next floor signal for the associated elevator car for generating a stop signal when the sum of said floor load signal and the car load signal is less than or equal to a predetermined passenger load value (A), $(L+W) \leqq A$, and for not generating said stop signal when said sum exceeds said load value, $(L+W) > A$.

2. The control means according to claim 1 wherein said means for generating a stop signal includes an adder having a first input connected to an output of said floor load sensor means for receiving said floor load signal, a second input connected to an output of the car load measuring device for receiving said ear load signal and an output for generating an output signal representing the sum of said floor load signal and said car load signal $(L+W)$; a comparator having a first input connected to said output of said adder, a second input connected to a source of a signal representing said predetermined passenger load value (A) and an output for generating an enable signal when said adder output signal is less than or equal to said load value, $(L+W) \leqq A$; and a logic circuit having a first input connected to said output of said comparator, a second input connected to an output of a floor memory for receiving a floor call signal representing floor calls to be served, a third input connected to an output of a selector device for receiving a next floor signal representing the next floor at which the elevator could stop, and an output for generating said stop signal when said enable signal, said next floor signal and said floor call signal are received.

3. The control means according to claim 2 wherein said floor load sensor means includes floor load sensors at each floor served by the elevator car, each of said floor load sensors having an input connected to said selector device and an output for generating said floor load signal representing the number of passengers waiting at the associated floor when said selector device generates said next floor signal corresponding to said associated floor, said outputs being connected to said first input of said adder.

4. The control means according to claim 2 wherein said floor load sensor means includes a load memory responsive to differences in the arrival and departure loads at each floor for generating at an output a floor load signal for each floor representative of the probable number of passengers waiting at the floor, said output being connected to said first input of said adder.

5. An apparatus for the load dependent control of an elevator comprising:

a floor selector means for generating a next floor signal representing the next floor at which an associated elevator car could stop;

a car load measuring device for generating a car load signal representing the number of passengers in the elevator car;

a floor call memory for generating a floor call signal representing floor calls to be serviced by the elevator car;

a floor load sensor means for generating a floor load signal representing the number of passengers waiting at the next floor at which the elevator car could stop; and means responsive to a floor call signal for said next floor, said next floor signal, said car load signal and said floor load signal for generating a stop signal to stop the elevator car at the next floor at which it could stop when the number of passengers in the elevator car and the number of passengers waiting at the next floor do not exceed a predetermined maximum number of passengers.

6. The apparatus according to claim 5 wherein said floor load sensor means includes a floor load sensor at each floor served by the elevator car, each said floor load sensor having an input connected to said floor selector means and an output connected to said means for generating said stop signal for generating a floor load signal representing the number of passengers waiting at an associated floor when said floor selector means generates a next floor signal representing said associated floor.

7. The apparatus according to claim 5 wherein said floor load sensor means includes a floor memory responsive to differences in said car load signal for generating a floor load signal representing the probable number of passengers waiting at each floor.

8. The apparatus according to claim 5 wherein said means for generating said stop signal includes means responsive to said car load signal and said floor load signal for generating an enable signal when the number of passengers represented by the sum of said car load signal and said floor load signal do not exceed said predetermined maximum number of passengers; and means responsive to said enable signal, said next floor signal and a floor call signal for the floor represented by said next floor signal for generating said stop signal.

9. The apparatus according to claim 8 wherein said means for generating said enable signal stops generating said enable signal when the number of passengers represented by the sum of said car load signal and said floor load signal exceeds said predetermined maximum number of passengers and said means for generating said stop signal is responsive to the absence of any one of said enable signal, said next floor signal and said floor call signal for generating a bypass signal to cause the elevator car to pass the next floor at which it could stop.

10. The apparatus according to claim 8 wherein said means for generating an enable signal includes an adder having a pair of inputs connected to said cabin load measuring device and said floor load sensor means respectively and an output for generating an output signal representing the total of the passengers in the elevator car and at the next floor, and a comparator having one input connected to said output of said adder, another input adapted to receive a signal representing said predetermined maximum number of passengers and an output for generating said enable signal.

11. The apparatus according to claim 8 wherein said means for generating said stop signal includes a plurality of AND gates each having a first input connected to receive said enable signal, a second input connected to receive said next floor signal representing an associated floor, a third input connected to receive said floor call signal representing a floor call for said associated floor, and an output for generating said stop signal in response to the presence of a signal at all of said first, second and third inputs.

12. In an elevator control including a floor selector for generating a next floor signal representing the next floor at which an elevator car could stop, a floor call memory for generating floor call signals representing requests for service at floors served by the elevator and a control means for generating a stop signal indicating that the car is to stop at a selected floor, the control means comprising:

a car load measuring device for generating a car load signal representing the number of passengers in an elevator car;

a floor load sensor means for generating a signal representing the number of passengers waiting for service at an associated floor;

enable means responsive to said car load signal and said floor load signal for generating an enable signal when the total number of passengers represented by said car load signal and said floor load signal does not exceed a predetermined limit; and logic means responsive to said enable signal, a next floor signal from a floor selector associated with the elevator car, and a floor call signal for a floor corresponding to the floor of said next floor signal for generating said stop signal.

13. The control means according to claim 12 wherein said enable means includes an adder responsive to said car load signal and said floor load signal for generating an output signal representing the total number of passengers in the elevator car and at the associated floor, and a comparator responsive to said output signal and a reference signal representing a maximum number of passengers for the elevator car for generating said enable signal when said reference signal exceeds said output signal.

14. The control means according to claim 13 wherein said logic means includes a plurality of AND gates, one for each floor at which the elevator car can stop, each of said AND gates responsive to said enable signal, said next floor signal for an associated floor, and said floor call signal for said associated floor for generating said stop signal.

15. The control means according to claim 14 wherein said floor load sensor means includes a floor load sensor at each floor responsive to said next floor signal for the associated floor for generating said floor load signal for said associated floor to said adder.

16. The control means according to claim 14 wherein said floor load sensor means includes a floor memory responsive to said ear load signal for generating said floor load signal representing the probable number of passengers waiting at each floor to said adder.

17. The control means according to claim 16 wherein said floor memory generates said floor load signal as the mean of the differences between the car load signals when the elevator car arrives at a floor and when it leaves the floor.

18. The control means according to claim 12 wherein said car load measuring device has an output; said floor load sensor means has an output; said enable means includes an adder having a pair of inputs connected to respective ones of said car load measuring device output and said floor load sensor output, and an output and includes a comparator having an input connected to said adder output and an output; and said logic means includes a plurality of AND gates each having a first input connected to said comparator output, a second input connected to an output of a floor call memory, a third input connected to an output of a floor selector, and an output for generating said stop signal.

19. A method of controlling an elevator car based upon load comprising the steps of:

(a) determining the number of passengers in the elevator car;

(b) determining the next floor at which the elevator car could stop;

(c) determining the number of passengers waiting at said next floor;

(d) summing the number of passengers determined in steps (a) and (c);

(e) comparing the sum obtained in step (d) with a predetermined value; and (f) generating a stop signal if the sum is less than or equal to said predetermined value and a floor call has been assigned to the elevator car for said next floor to stop the elevator car at said next floor.

20. The method according to claim 19 wherein step (c) is performed by:

(g) determining the difference between the number of passengers in the elevator car when the car arrives at said next floor and when the car leaves said next floor;

(h) performing step (g) each time the elevator car stops at said next floor; and (i) determining the mean of said differences as representing the number of passengers waiting at said next floor.

* * * * *